US007503779B1

(12) United States Patent
Yang et al.

(10) Patent No.: US 7,503,779 B1
(45) Date of Patent: Mar. 17, 2009

(54) ELECTRONIC DEVICE HAVING FOLDABLE PLUG

(75) Inventors: Ming-Tang Yang, Taoyuan Hsien (TW); Chun-Chen Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/057,670

(22) Filed: Mar. 28, 2008

(30) Foreign Application Priority Data

Jan. 16, 2008 (TW) ..... 97101703 A

(51) Int. Cl.
*H01R 13/44* (2006.01)

(52) U.S. Cl. ..... 439/131

(58) Field of Classification Search ..... 439/131, 439/217, 218, 222
See application file for complete search history.

(56) References Cited

U.S. PATENT DOCUMENTS 5,692,921 A * 12/1997 Jennings ..... 439/346
7,134,887 B1 * 11/2006 Keely ..... 439/131
7,287,991 B1 * 10/2007 Li ..... 439/131
7,438,574 B2 * 10/2008 Neumann ..... 439/172
2004/0053536 A1 * 3/2004 Chen et al. ..... 439/638
2008/0076279 A1 * 3/2008 Wu et al. ..... 439/131

* cited by examiner

*Primary Examiner*—Neil Abrams
*Assistant Examiner*—Phuong Nguyen
(74) *Attorney, Agent, or Firm*—Kirton & McConkie; Evan R. Witt

(57) ABSTRACT

An electronic device includes a casing, a plug, a retaining element and a resilient element. The casing has multiple support members and multiple receiving parts. The plug has a rotating shaft and multiple pins. The rotating shaft includes a ratchet tenon and is pivotally supported on the support members. The pins are substantially perpendicular to the casing when the pins are rotated to the first position. The pins are received in the receiving parts of the casing when the pins are rotated to the second position. The retaining element includes a ratchet part. The resilient element is contacted with or sustained against the retaining element for providing a restoring force on the retaining element. The ratchet part is engaged with the ratchet tenon of the rotating shaft due to the restoring force, so that the pins are automatically fixed in either the first position or the second position.

20 Claims, 12 Drawing Sheets

30

30

ELECTRONIC DEVICE HAVING FOLDABLE PLUG

FIELD OF THE INVENTION

The present invention relates to an electronic device having a plug, and more particularly to an electronic device having a foldable plug.

BACKGROUND OF THE INVENTION

Power converters such as power adapters or chargers become indispensable electronic devices for many kinds of electrical apparatuses. For example, by means of the power adapters, the utility power may be rectified and then converted into DC power for supplying power-receiving devices such as notebook computers. Alternatively, by means of the chargers, the converted DC power may be charged into the rechargeable batteries of the power-receiving devices such as mobile phones or digital cameras.

A power converter principally includes a casing, a plug and a circuit board mounted within the casing. Via the plug, external power in transmitted to the circuit board. The arrangement of the circuit board is dependent on the function of the power converter, for example being as an adapter or a charger, to perform rectification or conversion for a power-receiving device.

Referring to FIG. 1, a schematic perspective view of a conventional power adapter is illustrated. The power adapter 10 of FIG. 1 includes a casing 11, a plug 12 and a circuit board (not shown) mounted within the casing 11. Conventionally, the plug 11 of a power adapter is composed of two conducting pins, which are projected from one side of the casing 10. In a case that the power adapter is not in use, a user is easily hurt by the tips of projected pins or the projected pins are readily bent or broken due to a sudden impact. In addition, the plug 12 is difficultly stored when the power adapter is not used.

Recently, a power converter having a foldable plug has been developed in order to solve the above-mentioned problems. Please refer to FIG. 2A and FIG. 2B, which are respectively perspective and cross-sectional views illustrating a power converter having a foldable plug. The power converter 20 of FIG. 2A and FIG. 2B includes a casing 21 and a plug 22. The casing 21 further has a concave portion 23 near the top edge of the casing 21. The plug 22 principally includes a rod 220, two first pins 221 and two second pins 222. Both ends of the rod 220 are formed as tenons 2201. The first pins 221 and the second pins 222 respectively have holes 223 and 224 corresponding to the tenons 2201. The tenons 2201 are inserted into the holes 223 and 224 such that the first pins 221 and the second pins 222 are fixed onto the rod 220. Each sidewall of the concave portion 23 has a spring receptacle 226 containing a spring 227 therein. An end of the spring 227 is in contact with a side of the spring receptacle 226 and the other end of the spring 227 is coupled with a sustaining element 228. The sustaining element 228 is embedded into an indentation 225 of the first pin 221. As a consequence, the plug 22 is positioned in the concave portion 23 by the resilience force of the springs 227. By rotating the first pins 221 with respect to the rod 220, the second pins 222 are rotated to be contacted with contact points of the circuit board. Meanwhile, the plug 22 may be inserted into a power socket (not shown) to receive external power.

Although the above-mentioned power converter has a foldable plug, there are still some drawbacks. For example, the configuration of the foldable plug and the process for assembling such a foldable plug are complicated. For switching the first pins 221 of the plug 22 from the upright position to the folded position, an external force needs to be continuously exerted on the first pins 221. If the external force is eliminated during the first pins 221 is switched from the upright position to the folded position, the first pins 221 will be located between the upright position and the folded position. Under this circumstance, the plug is usually not securely positioned on the casing because the pins are easily detached from the tenons.

Therefore, there is a need of providing an electronic device having a foldable plug so as to obviate the drawbacks encountered from the prior art.

SUMMARY OF THE INVENTION

It is an object of the present invention to provide an electronic device having a foldable plug, in which the foldable plug is easily assembled and securely fixed in either a folded position or an upright position.

Another object of the present invention provides an electronic device having a foldable plug, is which the touch feel of operating the plug is enhanced.

In accordance with an aspect of the present invention, there is provided an electronic device having a foldable plug. The electronic device includes a casing, a plug, a circuit board, a retaining element and a resilient element. The casing has multiple support members, multiple perforations and multiple receiving parts. The plug has a rotating shaft and multiple pins. The rotating shaft includes a ratchet tenon and is pivotally supported on the support members such that the pins are rotatable with respect to the rotating shaft to at least a first position and a second position. The pins are penetrated through the perforation and substantially perpendicular to the casing when the pins are rotated to the first position. The pins are received in the receiving parts of the casing when the pins are rotated to the second position. The circuit board is disposed within the casing and includes multiple contact elements corresponding to the pins. The retaining element is disposed adjacent to the rotating shaft of the plug and includes a ratchet part, wherein the ratchet part is engageable with the ratchet tenon of the rotating shaft. The resilient element is contacted with or sustained against the retaining element for providing a restoring force on the retaining element. The ratchet part is engaged with the ratchet tenon of the rotating shaft due to the restoring force, so that the pins are automatically fixed in either the first position or the second position.

In accordance with another aspect of the present invention, there is provided an electronic device having a foldable plug. The electronic device includes a casing, a plug, a circuit board, a retaining element and a resilient element. The casing has multiple support members and a receiving part. The plug has a rotating shaft and multiple pins. The rotating shaft includes a ratchet tenon on a first sidewall thereof and is pivotally supported on the support members such that the pins are rotatable with respect to the ratchet tenon of the rotating shaft to at least a first position and a second position. The pins are penetrated through the perforation and substantially perpendicular to the casing when the pins are rotated to the first position. The pins are received in the receiving part of the casing when the pins are rotated to the second position. The circuit board is disposed within the casing and including multiple contact elements corresponding to the pins. The retaining element is disposed adjacent to the rotating shaft of the plug and including a ratchet part, wherein the ratchet part is engageable with the ratchet tenon of the rotating shaft. The resilient element is contacted with or sustained against the retaining element for providing a restoring force on the retaining element. The ratchet part is engaged with the ratchet tenon of the rotating shaft due to the restoring force, so that the pins are automatically fixed in either the first position or the second position.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
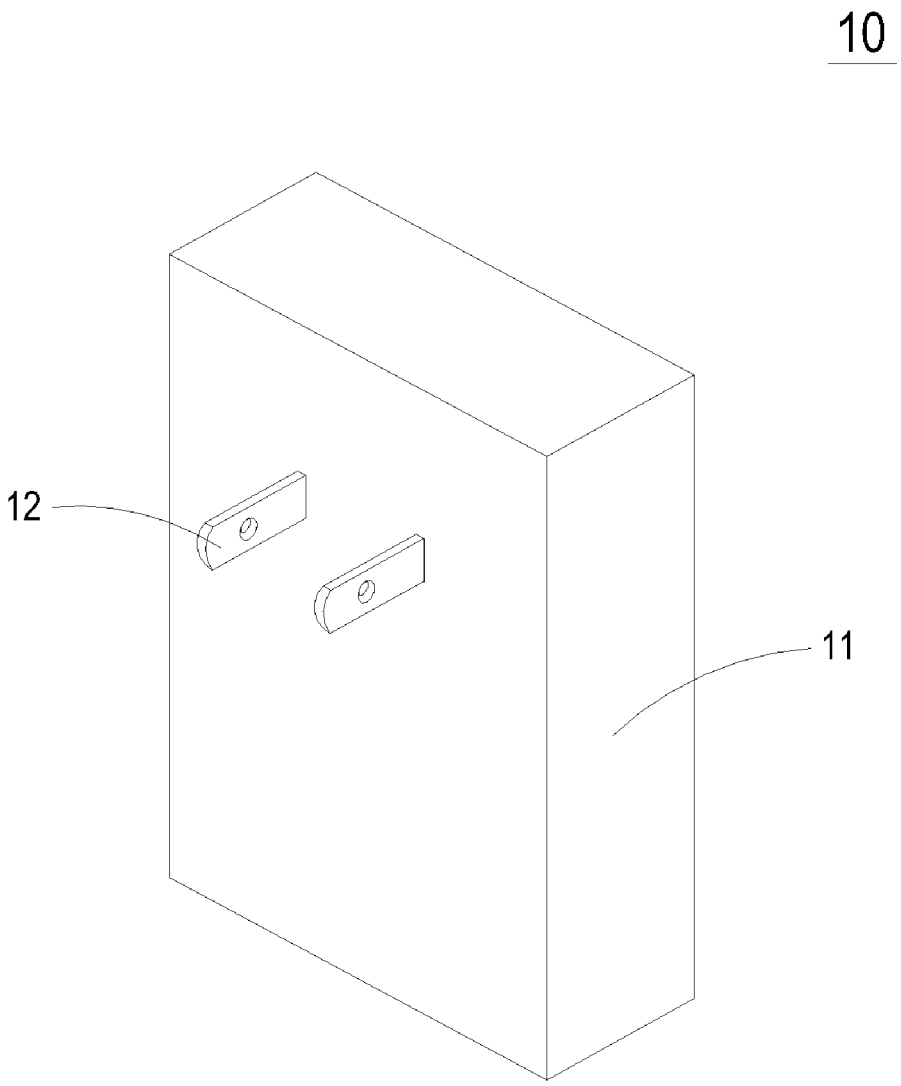
FIG. 1 PRIOR ART
FIG. 1 is a schematic perspective view of a conventional power adapter.
Figure 2A:
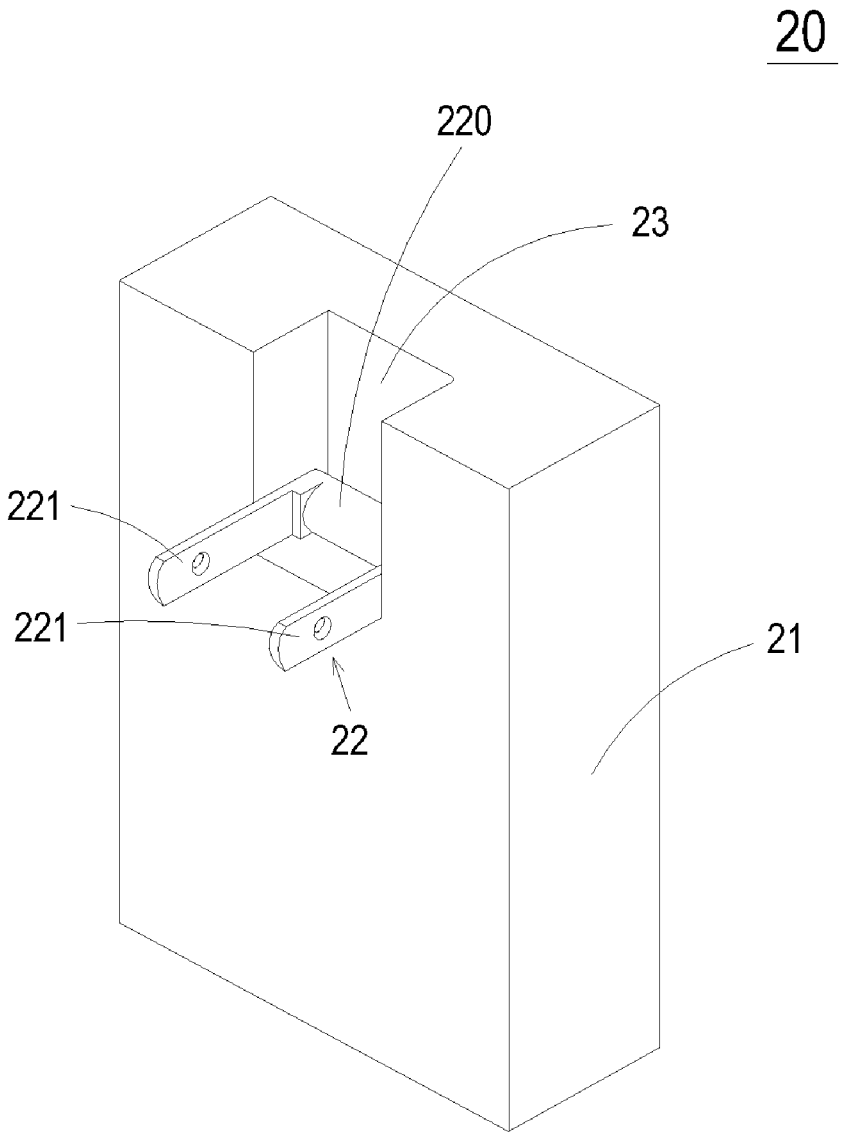
FIG. 2A PRIOR ART
FIG. 2A and FIG. 2B are respectively perspective and cross-sectional views illustrating a power converter having a foldable plug.
Figure 2B:
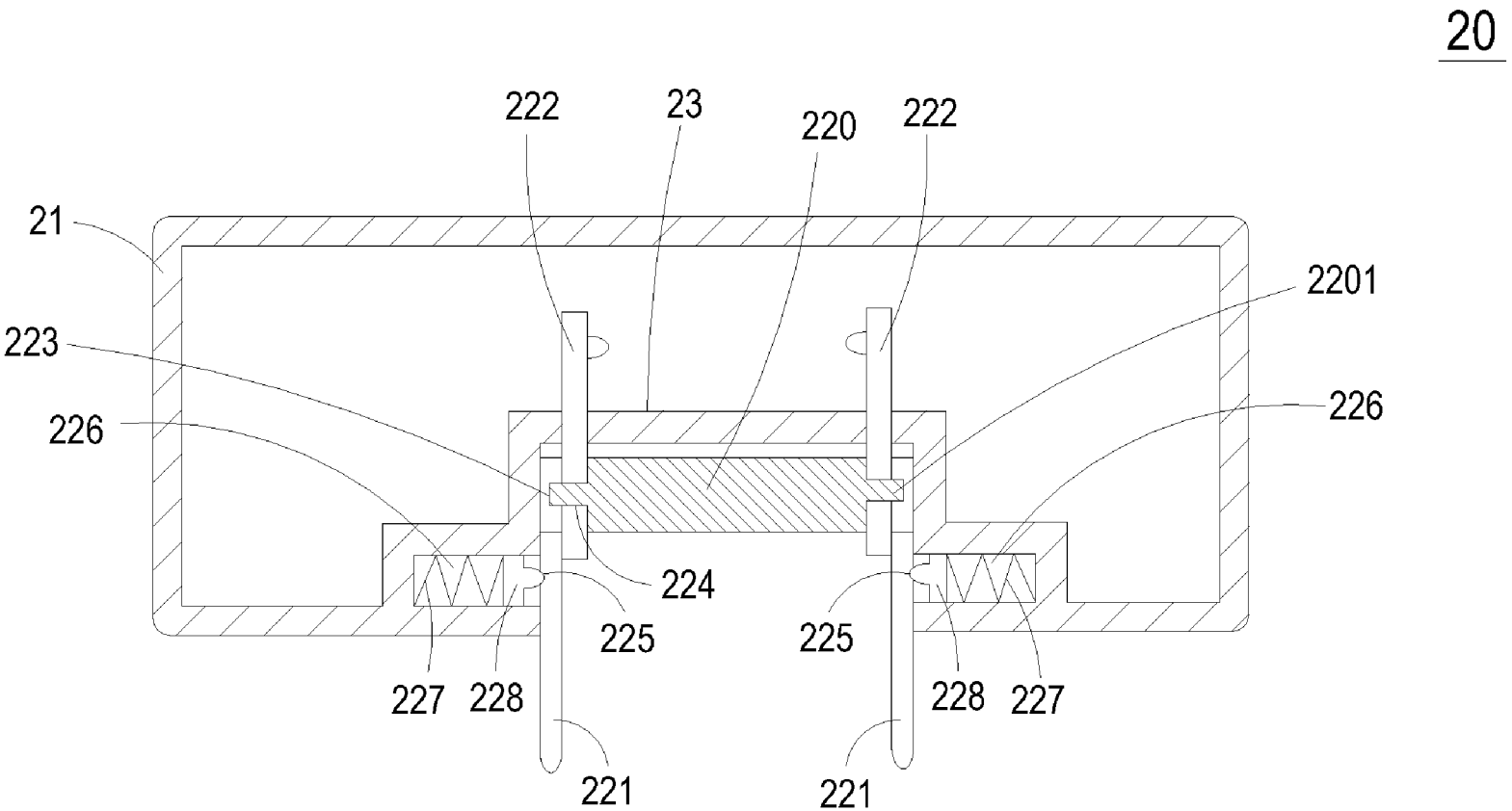
FIG. 2B PRIOR ART
Figure 3A:
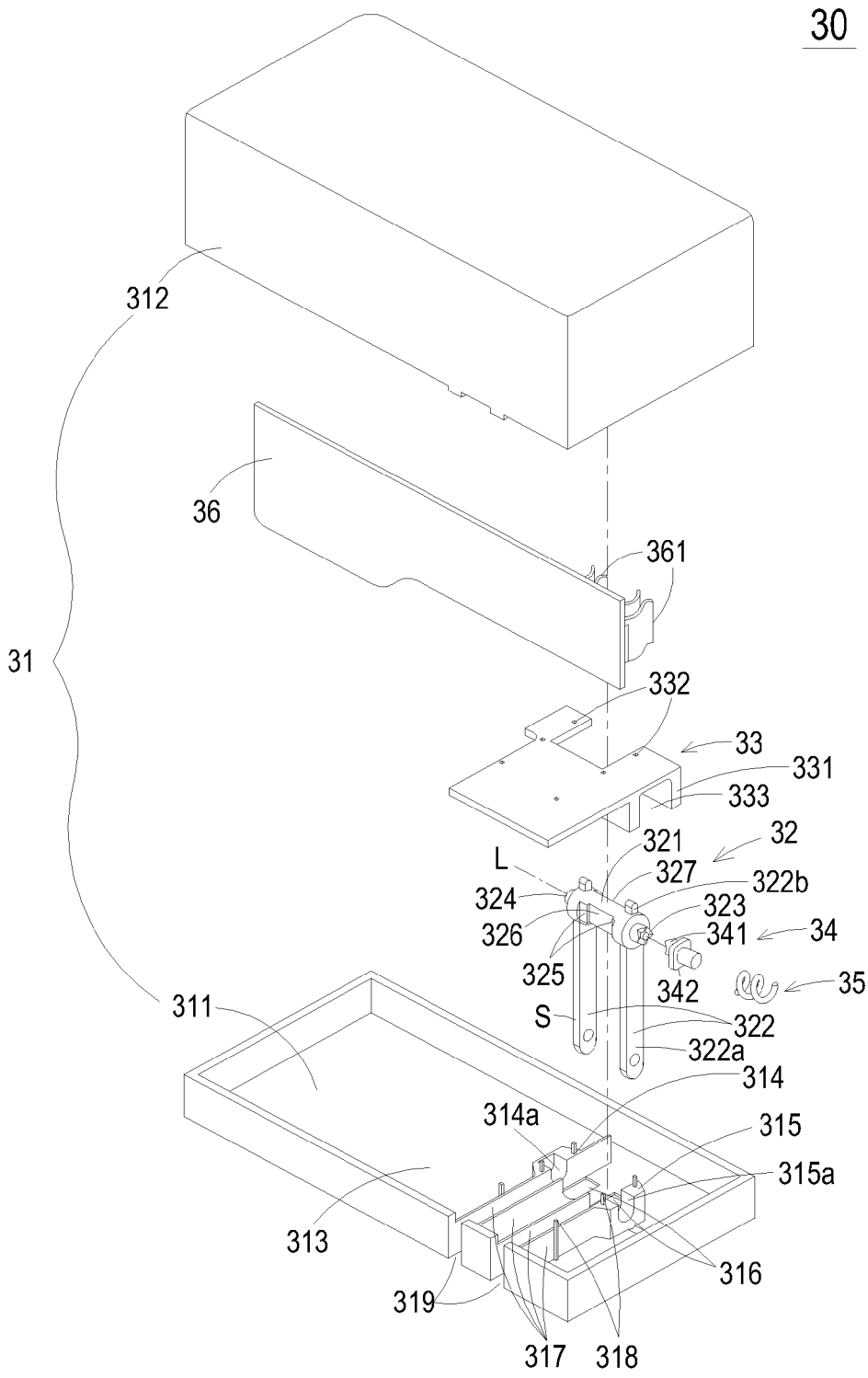
FIG. 3A is a schematic exploded view illustrating an electronic device having a foldable plug according to a first preferred embodiment of the present invention.

Please refer to FIG. 3A, which is a schematic exploded view illustrating an electronic device having a foldable plug according to a first preferred embodiment of the present invention. An example of the electronic device 30 includes but is not limited to a power converter. The electronic device 30 principally includes a casing 31, a plug 32, a fixing plate 33, a retaining element 34, a resilient element 35 and a circuit board 36. The casing 31 includes a first cover 311, a second cover 312, a first support member 314, a second support member 315 and a plurality of perforations 316. The first support member 314 and the second support member 315 are disposed on an inner surface 313 of the first cover 31. The perforations 316 are penetrated through the first cover 31 and extended from the support members 314 and 315 to an edge of the first cover 311.

In some embodiments, several partition plates 317 are protruded from the inner surface 313 of the first cover 31. The partition plates 317 are connected to the first support member 314 and the second support member 315 and extended along the peripheries of the perforations 316. A first notch 314*a* and a second notch 315*a* are formed in the first support member 314 and the second support member 315, respectively. The second notch 315*a* extends transversely through the second support member 315. In some embodiments, some posts 318 are protruded from the first support member 314, the second support member 315, the partition plates 317 and the inner surface 313 of the first cover 311.

In some embodiments, the plug 32 includes a rotating shaft 321, multiple (e.g. two) pins 322 and a ratchet tenon 323. The rotating shaft 321 includes a first sidewall 326, a second sidewall 327 and a center axis L. Each pin 322 is partially embedded into the rotating shaft 321 such that a first end 322*a* and a second end 322*b* are arranged on opposite sides of the rotating shaft 321. The ratchet tenon 323 is arranged on one terminal of the rotating shaft 321 and corresponding to the second notch 315*a* of the second support member 315. The pins 322 are substantially perpendicular to the center axis L of the rotating shaft 321. Under this circumstance, the small-width surfaces S of the pins 322 are rotated with respect to the center axis L.

In some embodiments, corresponding to the first notch 314*a* of the first support member 314, the second terminal of the rotating shaft 321 is formed as a protrusion tenon 324. The protrusion tenon 324 and the ratchet tenon 323 are received in the first notch 314*a* of the first support member 314 and the second notch 315*a* of the second support member 315, respectively. The pins 322 of the plug 32 can be rotated to a first position where the first ends 322*a* thereof are protruded through the perforations 316 and substantially perpendicular to the outer surface of the first cover 311. Alternatively, the pins 322 can be rotated to a second position where the pins 322 are folded to be substantially parallel with the outer surface of the first cover 311. For clarification, the first position and the second position are referred as an upright position and a folded position, respectively.

Optionally, the rotating shaft 321 of the plug 32 further includes at least one confining part 325. The confining part 325 is for example a flat raised surface between the pins 322. When the pins 322 of the plug 32 are rotated to the upright position, the confining part 325 is sustained against the peripheral of the partition plate 317 for facilitating confining the plug 32 in the upright position.

After the protrusion tenon 324 and the ratchet tenon 323 of the rotating shaft 321 are respectively received in the first notch 314*a* of the first support member 314 and the second notch 315*a* of the second support member 315 and the first ends 322*a* of the pins 322 are penetrated through the perforations 316, the fixing plate 33 is placed on the first support member 314, the second support member 315 and the partition plates 317 to shelter the first notch 314*a* and the second notch 315*a*. Moreover, multiple receiving parts 319 are defined by the fixing plate 33, the partition plates 317 and the perforations 316. When the pins 322 are rotated to the second position, the first ends 322*a* of the pins 322 are stored in the receiving parts 319. Furthermore, an extension part 331 is protruded from an edge of the fixing plate 33. After the fixing plate 33 is placed on the first support member 314, the second support member 315 and the partition plates 317, the extension part 331 is disposed beside the second notch 315*a* and cooperated with the inner surface 313 of the first cover 311 to define a channel 333. The retaining element 34 and the resilient element 35 can be received in the channel 333 such that the retaining element 34 is able to shift within the channel 333 but fails to be rotated within the channel 333. Alternatively, the extension part 331 is not disposed on the fixing plate 33 but another extension part (not shown) is protruded from the inner surface 313 of the first cover 311 and beside the second notch 315*a*. The extension part is cooperated with the fixing plate 33 to define a channel 333 to receive the retaining element 34 and the resilient element 35 therein.

In some embodiments, the fixing plate 33 has several openings 332. Corresponding to the openings 332, some posts 318 are protruded from the first support member 314, the second support member 315, the partition plates 317 and the inner surface 313 of the first cover 311. The fixing plate 33 is initially fixed on the first support member 314, the second support member 315 and the partition plates 317 by penetrating the posts 318 through the openings 332. After the posts 318 is penetrated through the openings 332, the fixing plate 33 may be securely fixed on the first support member 314, the second support member 315 and the partition plates 317 by using an ultrasonic welding process or an adhesive bonding process. Alternatively, the fixing plate 33 can be directly fixed on the first support member 314, the second support member 315 and the partition plates 317 by using an ultrasonic welding process, a thermal welding process or an adhesive bonding process.

In some embodiments, the retaining element 34 is arranged between the rotating shaft 321 of the plug 32 and the first cover 311, and includes a ratchet part 341. The ratchet part 341 is disposed beside the ratchet tenon 323 of the rotating shaft 321. When the ratchet part 341 of the retaining element 34 is rotated, the ratchet tenon 323 received within the second notch 315*a* of the second support member 315 is engaged with the ratchet part 341 of the retaining element 34.

Furthermore, the retaining element 34 includes a sustaining part 342 beside the ratchet part 341. The sustaining part 342 of the retaining element 34 is received in the channel 333, which is defined by the extension part 331 of the fixing plate 33 and the inner surface 313 of the first cover 311. Since the sustaining part 342 is confined by the extension part 331 of the fixing plate 33, the retaining element 34 is able to shift within the channel 333 but fails to be rotated within the channel 333.

An exemplary resilient element 35 is a spring, which is disposed between the retaining element 34 and the first cover 311. The resilient element 35 is sustained against the retaining element 34 and the first cover 311. When the resilient element 35 is compressed by the retaining element 34, an elastic force is exerted on the retaining element 34. Due to the restoring force of the resilient element 35, the ratchet part 341 of the retaining element 34 is engaged with the ratchet tenon 323 of the plug 32. Consequently, the plug 32 is automatically positioned at either the upright position or the folded position.

Figure 3B:
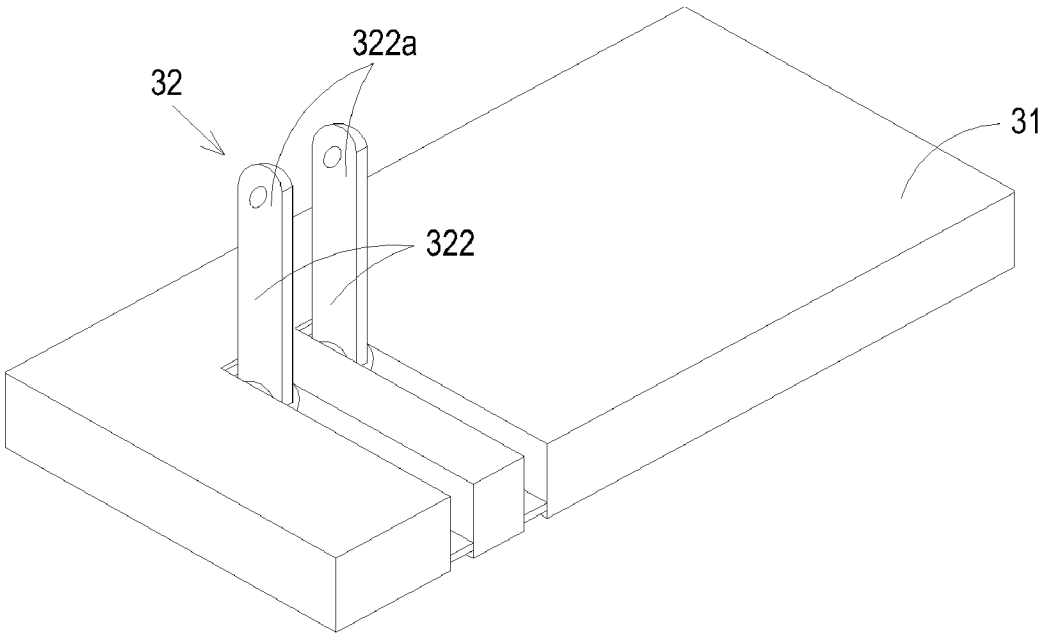
FIG. 3B is a schematic partial perspective view illustrating the electronic device of FIG. 3A, in which the plug is rotated to the upright position.

The circuit board 36 and the plug 32 are arranged on opposite sides of the fixing plate 33. The circuit board 36 is disposed within the casing 31, and includes a power converting circuit (not shown) and multiple contact elements 361 corresponding to the second ends 322*b* of the pins 322. By the power converting circuit, the utility power is converted into regulated DC power. The contact elements 361 are substantially clamping structures. When the plug 32 is rotated to the upright position as shown in FIG. 3B, the second ends 322*b* of the pins 322 are clamped by and contacted with the contact elements 361 of the circuit board 36. Whereas, when the plug 32 is rotated to the folded position, the contact elements 361 of the circuit board 36 are separated from the second ends 322*b* of the pins 322 as shown in FIG. 3C.

Figure 3C:
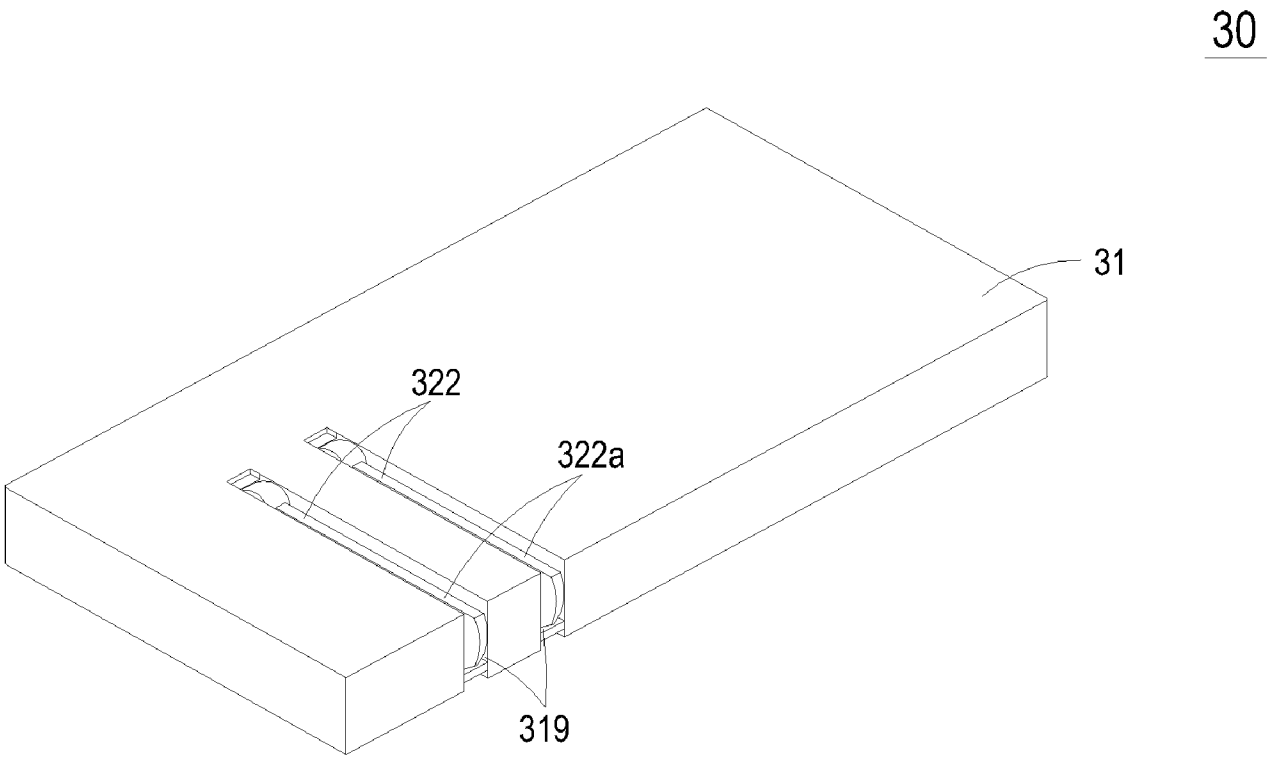
FIG. 3C is a schematic partial perspective view illustrating the electronic device of FIG. 3A, in which the plug is rotated to the folded position.
Figure 3D:
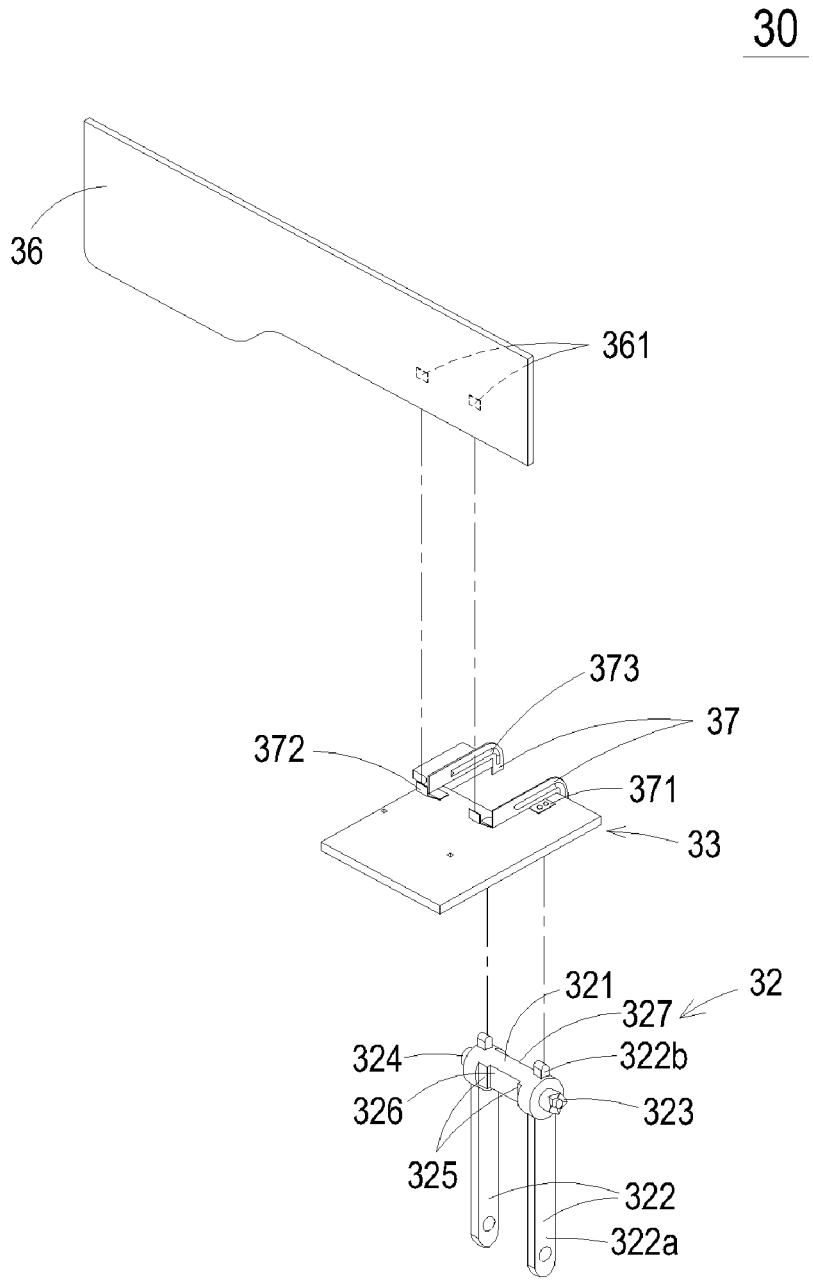
FIG. 3D is a schematic exploded view illustrating an electronic device having a foldable plug according to a second preferred embodiment of the present invention.

As shown in FIGS. 3A, 3B and 3C, the second ends 322*b* of the pins 322 are contacted with the contact elements 361 of the circuit board 36 when the plug 32 is rotated to the upright position but separated from the contact elements 361 of the circuit board 36 when the plug 32 is rotated to the folded position. It is noted that, however, those skilled in the art will readily observe that numerous modifications and alterations may be made while retaining the teachings of the invention. For example, the second ends 322*b* of the pins 322 are contacted with the contact elements 361 of the circuit board 36 when the plug 32 is rotated to the upright position and the folded position. As shown in FIG. 3D, the contact elements 361 of the circuit board 36 are contact pads. The fixing plate 33 has conductive elements 37 corresponding to the contact elements 361. Each conductive element 37 includes a fixing part 371, a first contact part 372 and a second contact part 373. Via the fixing parts 371, the conductive elements 37 are fixed on the fixing plate 33. The first contact parts 372 are continuously contacted with the contact elements 361 of the circuit board 36. The second contact parts 373 are continuously contacted with the second ends 322*b* of the pins 322. As a consequence, when the plug 32 is rotated to either the upright position or the folded position, the contact elements 361 of the circuit board 36 are always electrically connected with the second ends 322*b* of the pins 322 through the conductive elements 37.

Figure 4A:
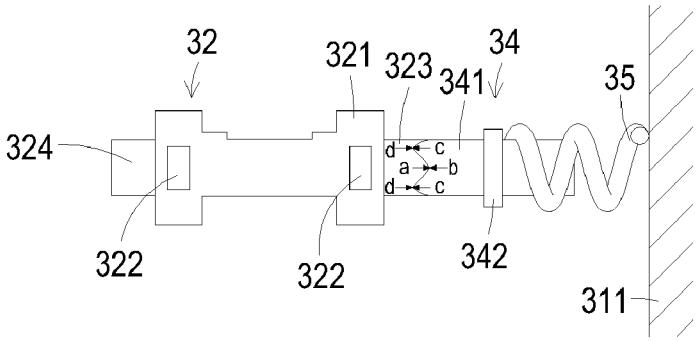
FIGS. 4A, 4B and 4C schematically illustrate the actions of the plug.
Figure 4B:
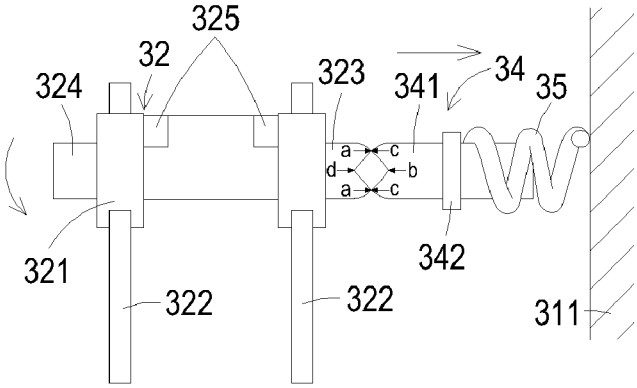
Figure 4C:
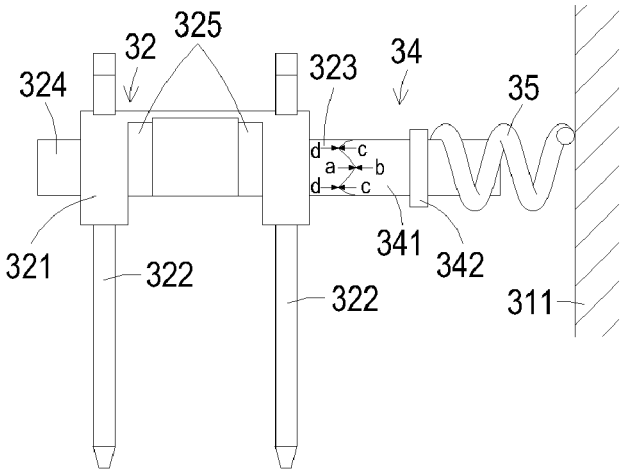

Hereinafter, the actions of the plug will be illustrated with reference to FIGS. 4A, 4B and 4C and also FIG. 3. As shown in FIG. 4A and FIG. 3C, the plug 32 is positioned at the folded position. Meanwhile, the ratchet part 341 of the retaining element 34 is engaged with the ratchet tenon 323 of the plug 32. That is, the retaining points a of the ratchet tenon 323 are sustained against the coupling points b of the ratchet part 341. Due to the restoring force of the resilient element 35, the ratchet part 341 of the retaining element 34 is engaged with the ratchet tenon 323 of the rotating shaft 321 (as shown in FIG. 4A). Consequently, the rotating shaft 321 fails to rotate such that the plug 32 is securely fixed in the folded position.

In response to an external force exerted on the first ends 322*a* of the pins 322, the pins 322 are rotated in the anti-clockwise direction with respect to the rotating shaft 321. Correspondingly, the ratchet tenon 323 of the rotating shaft 321 is rotated with the rotating shaft 321. Since the retaining element 34 is immobile, the ratchet tenon 323 upon rotation may exert a pushing force on the ratchet part 341 of the retaining element 34. Under this circumstance, the retaining element 34 is moved in the horizontal direction distant from the plug 32 so as to compress the resilient element 35. That is, during the ratchet tenon 323 of the rotating shaft 321 is rotated in the anti-clockwise direction, the retaining points a of the ratchet tenon 323 are contacted with the retaining points c of the ratchet part 341 of the retaining element 34 so as to push the retaining element 34 in the horizontal direction distant from the plug 32 (as is shown in FIG. 4B).

In a case that the retaining points a of the ratchet tenon 323 have not yet contacted with the retaining points c of the ratchet part 341 of the retaining element 34 and the external force is eliminated, the restoring force of the resilient element 35 will push back the retaining element 34. Since the ratchet tenon 323 has a slant surface from the retaining point a to the coupling point d and the ratchet part 341 also has a slant surface from the retaining point c to the coupling point b, the ratchet tenon 323 of the rotating shaft 321 will be rotated in the clockwise direction due to the restoring force of the resilient element 35. Until the retaining points a of the ratchet tenon 323 are sustained against the coupling points b of the ratchet part 341, the pins 322 are automatically returned to the folded position as shown in FIG. 4A. Under this circumstance, the ratchet part 341 of the retaining element 34 is engaged with the ratchet tenon 323 of the plug 32 and thus the plug 32 is positioned in the folded position.

On the other hand, if the external force is continuous and the retaining points a of the ratchet tenon 323 have passes over the retaining points c of the ratchet part 341 of the retaining element 34, the restoring force of the resilient element 35 will push back the retaining element 34. Since the ratchet tenon 323 has a slant surface from the retaining point a to the coupling point d and the ratchet part 341 also has a slant surface from the retaining point c to the coupling point b, the retaining points a of the ratchet tenon 323 will be sustained against the coupling points b of the ratchet part 341 due to the restoring force of the resilient element 35. Under this circumstance, the ratchet part 341 of the retaining element 34 is engaged with the ratchet tenon 323 of the rotating shaft 321 (as shown in FIG. 4C) and thus the plug 32 is positioned in the upright position (as shown in FIG. 3A).

For a purpose of storing the pins 322 of the plug 32 in the receiving parts 319, an addition external force may be applied on the first ends 322*a* of the pins 322 of the plug 32 such that the pins 322 are rotated in the clockwise direction with respect to the rotating shaft 321. The actions of the plug are identical to those described in FIG. 4, and are not redundantly described herein. After the plug 322 is rotated to the folded position, the ratchet part 341 of the retaining element 34 is engaged with the ratchet tenon 323 of the rotating shaft 321. Due to the restoring force of the resilient element 35, the ratchet part 341 of the retaining element 34 is engaged with the ratchet tenon 323 of the rotating shaft 321. Consequently, the rotating shaft 321 fails to rotate such that the plug 32 is securely fixed in the folded position.

Figure 5A:
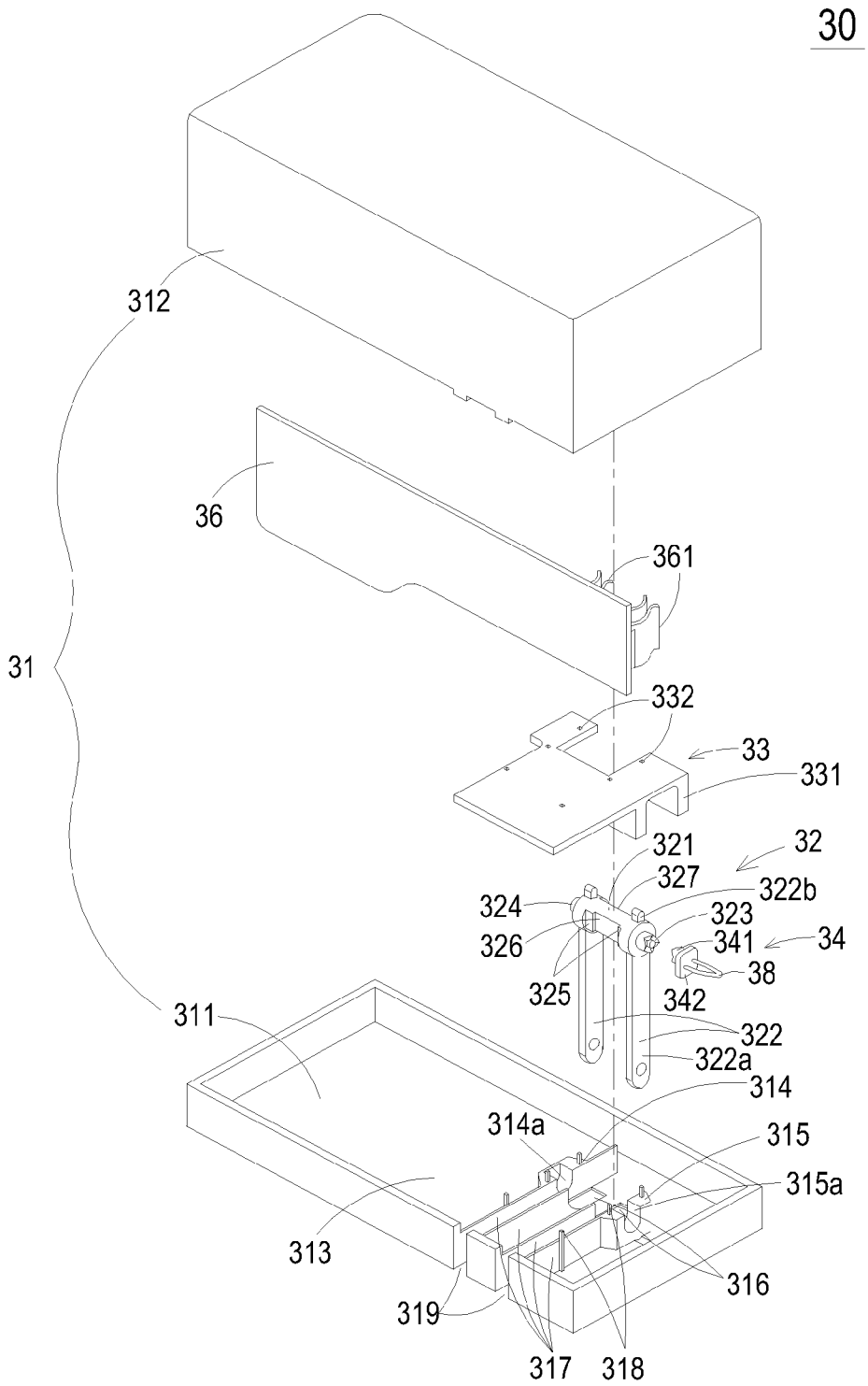
FIG. 5A is a schematic exploded view illustrating an electronic device having a foldable plug according to a third preferred embodiment of the present invention.

FIG. 5A is a schematic exploded view illustrating an electronic device having a foldable plug according to a third preferred embodiment of the present invention. The casing 31, the plug 32, the fixing plate 33, the retaining element 34 and the circuit board 36 included in this embodiment are similar to those shown in FIG. 3A, and are not redundantly described. Whereas, the resilient element of FIG. 5A is integrated into the retaining element 34. The resilient element has an arc-shaped structure 38. A terminal of the arc-shaped structure 38 is contacted with the first cover 311. When the arc-shaped structure 38 is compressed by the retaining element 34, an elastic force is exerted on the retaining element 34. Due to the restoring force of the arc-shaped structure 38, the ratchet part 341 of the retaining element 34 is engaged with the ratchet tenon 323 of the plug 32. Consequently, the plug 32 is automatically positioned at either the upright position or the folded position.

Figure 5B:
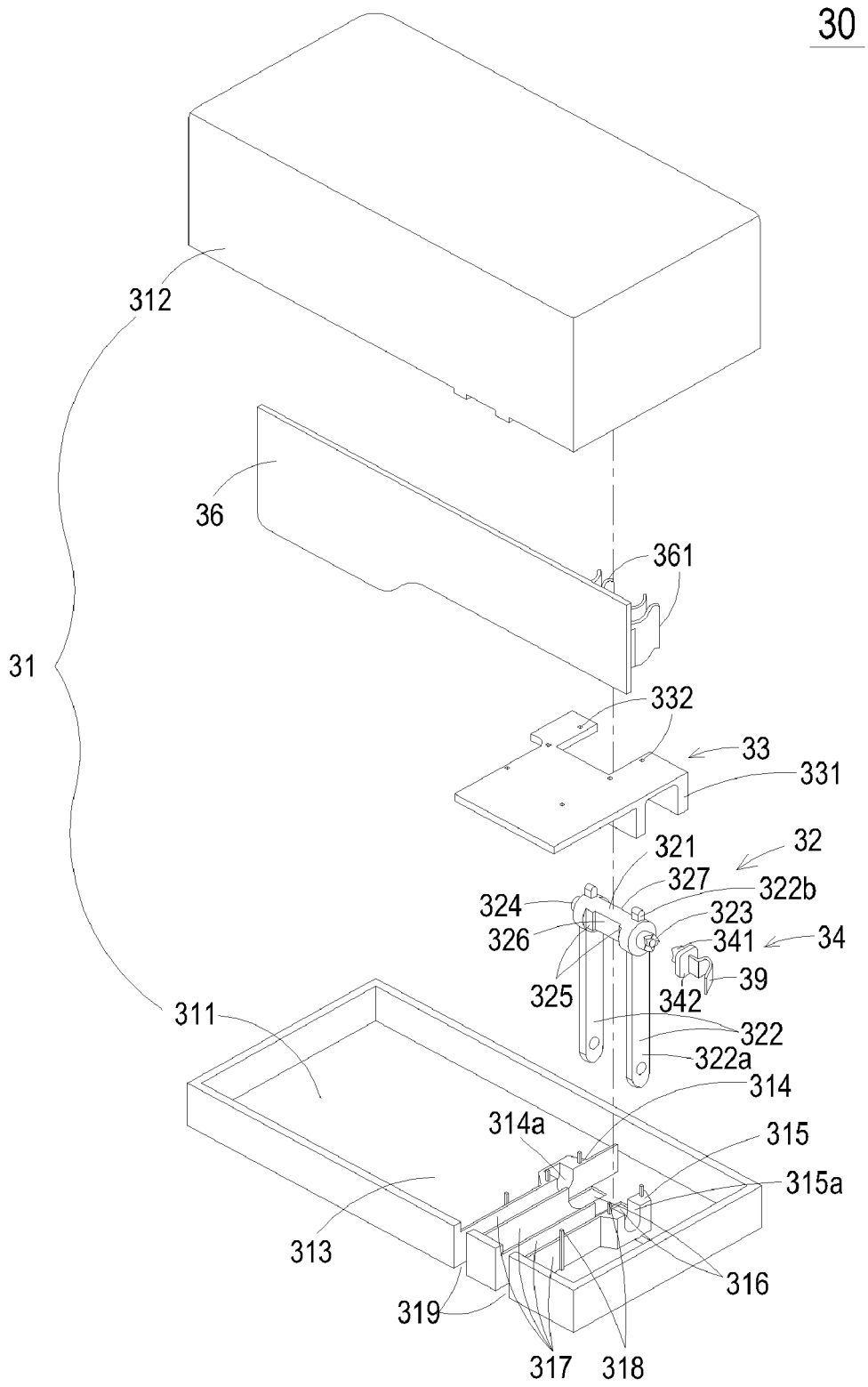
FIG. 5B is a schematic exploded view illustrating an electronic device having a foldable plug according to a fourth preferred embodiment of the present invention.

FIG. 5B is a schematic exploded view illustrating an electronic device having a foldable plug according to a fourth preferred embodiment of the present invention. The casing 31, the plug 32, the fixing plate 33, the retaining element 34 and the circuit board 36 included in this embodiment are similar to those shown in FIG. 3A, and are not redundantly described. Whereas, the resilient element of FIG. 5B is integrated into the retaining element 34. The resilient element has a hook structure 39. A terminal of the hook structure 39 is contacted with the first cover 311. Due to the restoring force of the hook structure 39, the ratchet part 341 of the retaining element 34 is engaged with the ratchet tenon 323 of the plug 32. Consequently, the plug 32 is automatically positioned at either the upright position or the folded position.

Figure 6A:
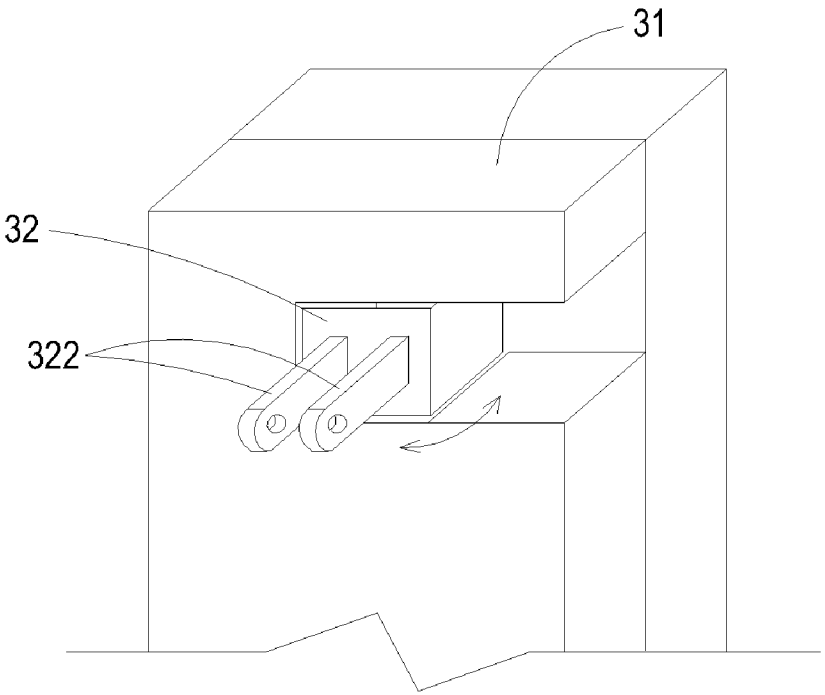
FIGS. 6A and 6B are partially schematic views illustrating an electronic device having a foldable plug according to a fifth preferred embodiment of the present invention.
Figure 6B:
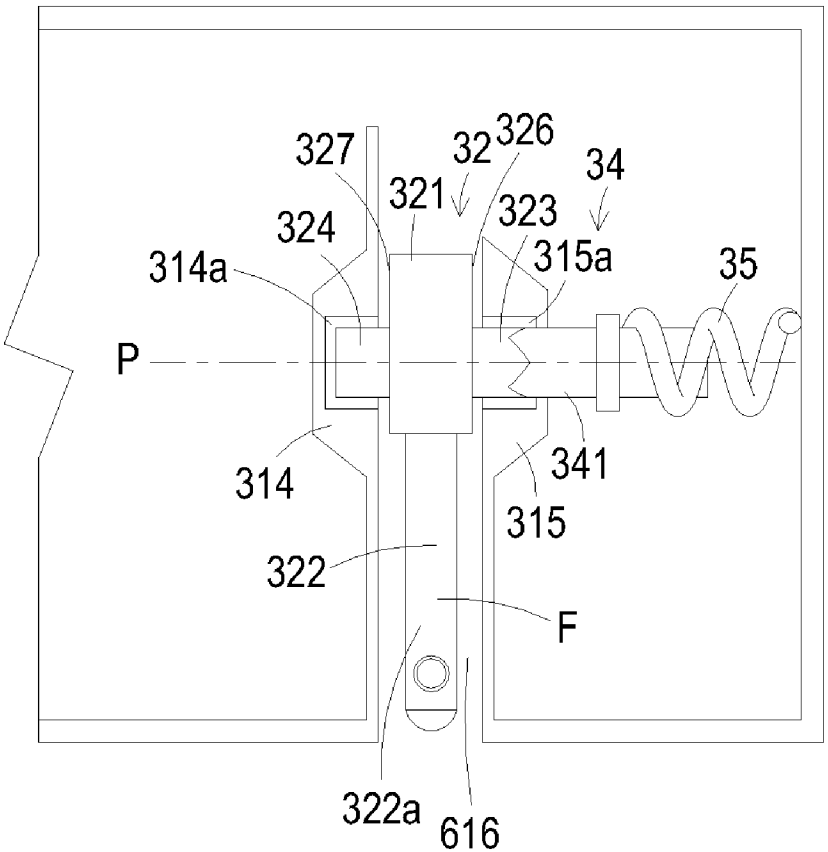

FIGS. 6A and 6B are partially schematic views illustrating an electronic device having a foldable plug according to a fifth preferred embodiment of the present invention. The fixing plate 33, the retaining element 34, the resilient element 35 and the circuit board 36 included in this embodiment are similar to those shown in FIG. 3A, and are not redundantly described. Whereas, the pins 322 of the plug 32 can be stored in a common concave portion 616 in the casing 31. The plug 32 also includes a rotating shaft 321, multiple pins 322, a ratchet tenon 323 and a protrusion tenon 324. The ratchet tenon 323 is vertically arranged on a first sidewall 326 of the rotating shaft 321. The protrusion tenon 324 is vertically arranged on a second sidewall 327 of the rotating shaft 321 and opposed to the ratchet tenon 323. The ratchet tenon 323 and the protrusion tenon 324 are arranged along the center axis P of the rotating shaft 321. Under this circumstance, the large-width surfaces F of the pins 322 are rotated with respect to the center axis P.

After the protrusion tenon 324 and the ratchet tenon 323 of the rotating shaft 321 are respectively received in the first notch 314*a* of the first support member 314 and the second notch 315*a* of the second support member 315, the pins 322 of the plug 32 can be received in the common concave portion 616. As a result, the pins 322 of the plug 32 are rotated with respect to the center axis P of the rotating shaft 321 to a first position where the first ends 322*a* thereof are protruded through the common concave portion 616 and substantially perpendicular to the outer surface of the first cover 311. Alternatively, the pins 322 can be rotated to a second position where the pins 322 are folded to be received in the common concave portion 616 of the casing 31. Since the relationship between the ratchet part 341 of the retaining element 34 and the ratchet tenon 323 of the plug 32 are similar to those described in FIG. 4 and are not redundantly described herein.

From the above description, the ratchet part of the retaining element can be engaged with the ratchet tenon of the plug due to the restoring force of the resilient element exerting on the retaining element. As a consequence, the pins of the plug can be positioned in either the upright position or the folded position. The foldable plug is easily assembled and securely fixed in either a folded position or an upright position. Moreover, the touch feel of operating the plug is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic device having a foldable plug, said electronic device comprising:

a casing having multiple support members, multiple perforations and multiple receiving parts;

a plug having a rotating shaft and multiple pins, said rotating shaft including a ratchet tenon and being pivotally supported on said support members such that said pins are rotatable with respect to said rotating shaft to at least a first position and a second position, wherein said pins are penetrated through said perforation and substantially perpendicular to said casing when said pins are rotated to said first position, and said pins are received in said receiving parts of said casing when said pins are rotated to said second position;

a circuit board disposed within said casing and including multiple contact elements corresponding to said pins;

a retaining element adjacent to said rotating shaft of said plug and including a ratchet part, wherein said ratchet part is engageable with said ratchet tenon of said rotating shaft; and a resilient element contacted with or sustained against said retaining element for providing a restoring force on said retaining element, wherein said ratchet part is engaged with said ratchet tenon of said rotating shaft due to said restoring force, so that said pins are automatically fixed in either said first position or said second position.

2. The electronic device having a foldable plug according to claim 1 wherein said ratchet tenon is arranged on a first terminal of said rotating shaft.

3. The electronic device having a foldable plug according to claim 2 further comprising a fixing plate disposed on said support member such that said plug is pivotally supported between said support member and said fixing plate.

4. The electronic device having a foldable plug according to claim 3 wherein each pin is partially embedded into said rotating shaft such that a first end and a second end of said pin are arranged on opposite sides of said rotating shaft.

5. The electronic device having a foldable plug according to claim 4 wherein said circuit board has multiple contact elements corresponding to the second ends of said pins.

6. The electronic device having a foldable plug according to claim 5 wherein said contact elements of said circuit board are clamping structures, which are contacted with said second ends of said pins when said plug is positioned at said first position, and said contact elements of said circuit board are separated from said second ends of said pins when said plug is positioned at said second position.

7. The electronic device having a foldable plug according to claim 5 wherein said fixing plate has multiple conductive elements corresponding to said contact elements, said conductive elements include respective fixing parts, first contact parts and second contact parts, said conductive elements are fixed on said fixing plate via said fixing parts, said first contact parts are continuously contacted with said contact elements of the circuit board, and said second contact parts are continuously contacted with said second ends of said pins when said plug is rotated to either said first position or said second position.

8. The electronic device having a foldable plug according to claim 7 wherein said contact elements of said circuit board are contact pads.

9. The electronic device having a foldable plug according to claim 3 further including multiple partition plates, which are protruded from an inner surface of said casing, wherein said partition plates are connected to said support members and extended along the peripheries of the perforations.

10. The electronic device having a foldable plug according to claim 9 further includes at least one confining part, which is formed on said rotating shaft of said plug and between said pins, wherein said confining part is sustained against a peripheral of said partition plate for facilitating confining said plug in said first position.

11. The electronic device having a foldable plug according to claim 9 wherein a second terminal of said rotating shaft is formed as a protrusion tenon, said support members have notches corresponding to said protrusion tenon and said ratchet tenon of said rotating shaft, and said protrusion tenon and said ratchet tenon of said rotating shaft are supported on said notches.

12. The electronic device having a foldable plug according to claim 11 wherein said fixing plate is disposed on said support member to shelter said notches, and said fixing plate cooperated with said partition plates and said perforations defines said multiple receiving parts.

13. The electronic device having a foldable plug according to claim 11 wherein an extension part is protruded from an edge of said fixing plate and arranged adjacent to said notch for supporting said ratchet tenon, so that a channel is defined by said extension part and said inner surface of said casing to receive said retaining element and said resilient element therein.

14. The electronic device having a foldable plug according to claim 13 wherein said retaining element further includes a sustaining part confined by said extension part of said fixing plate, such that said retaining element is able to shift within said channel but fails to be rotated within said channel.

15. The electronic device having a foldable plug according to claim 1 wherein said resilient element is a spring.

16. The electronic device having a foldable plug according to claim 1 wherein said resilient element is integrated into said retaining element.

17. The electronic device having a foldable plug according to claim 16 wherein said resilient element has an arc-shaped structure or a hook structure.

18. The electronic device having a foldable plug according to claim 1 wherein said electronic device is a power converter.

19. An electronic device having a foldable plug, said electronic device comprising:

a casing having multiple support members and a receiving part;

a plug having a rotating shaft and multiple pins, said rotating shaft including a ratchet tenon on a first sidewall thereof and being pivotally supported on said support members such that said pins are rotatable with respect to said ratchet tenon of said rotating shaft to at least a first position and a second position, wherein said pins are penetrated through said perforation and substantially perpendicular to said casing when said pins are rotated to said first position, and said pins are received in said receiving part of said casing when said pins are rotated to said second position;

a circuit board disposed within said casing and including multiple contact elements corresponding to said pins;

a retaining element adjacent to said rotating shaft of said plug and including a ratchet part, wherein said ratchet part is engageable with said ratchet tenon of said rotating shaft; and a resilient element contacted with or sustained against said retaining element for providing a restoring force on said retaining element, wherein said ratchet part is engaged with said ratchet tenon of said rotating shaft due to said restoring force, so that said pins are automatically fixed in either said first position or said second position.

20. The electronic device having a foldable plug according to claim 19 wherein said plug further includes a protrusion tenon, which is vertically arranged on a second sidewall of said rotating shaft and opposed to said ratchet tenon.

* * * * *